US005349842A

United States Patent [19]

Heitze

[11] Patent Number: 5,349,842

[45] Date of Patent: Sep. 27, 1994

[54] COOLING DEVICE FOR THE PRESSING TOOLS OF AN UPSETTING PRESS AND METHOD FOR OPERATING THE COOLING DEVICE

[75] Inventor: Gerhard Heitze, Netphen, Fed. Rep. of Germany

[73] Assignee: SMS Schloemann-Siemag Aktiengesellschaft, Dusseldolf, Fed. Rep. of Germany

[21] Appl. No.: 812,104

[22] Filed: Dec. 23, 1991

[30] Foreign Application Priority Data

Dec. 24, 1990 [DE] Fed. Rep. of Germany ..... 4041787

[51] Int. Cl.[5] ..... B21D 37/16; B05B 1/14

[52] U.S. Cl. ..... 72/342.3; 239/436; 239/560

[58] Field of Search ..... 72/201, 236, 342.3; 29/527.7; 239/13, 436, 444, 556, 557, 560, 561

[56] References Cited

U.S. PATENT DOCUMENTS

| | | | |
|---|---|---|---|
| 4,463,587 | 8/1984 | Werner | 72/342.3 |
| 4,474,044 | 10/1984 | Leistner et al. | 72/13 |
| 5,094,094 | 3/1992 | Muramatsu et al. | 29/527.7 |

FOREIGN PATENT DOCUMENTS

| | | |
|---|---|---|
| 033730 | 2/1986 | Japan . |
| 005837 | 1/1988 | Japan . |
| 132740 | 6/1988 | Japan . |
| 273536 | 11/1988 | Japan . |
| 3118907 | 5/1991 | Japan . |
| 858726 | 1/1961 | United Kingdom . |

OTHER PUBLICATIONS

Naoi, T., *Development of a Slab Sizing Press,* Aug. 1988, Hitachi Review, vol. 37 No. 4, pp. 189–194.

*Primary Examiner*—Lowell A. Larson
*Assistant Examiner*—Thomas C. Schoeffler
*Attorney, Agent, or Firm*—Anderson Kill Olick & Oshinsky

[57] ABSTRACT

A cooling device for pressing tools of an upsetting press for the width reduction of rolled material, particularly of the width of slabs in hot-rolled wide strip roughing trains. The upsetting press includes two tool carriers which are arranged on both sides of the slab edges. The tool carriers receive the pressing tools and are movable relative to each other. The upsetting press comprises at least one cooling agent nozzle which is directed toward the front edge of each pressing tool.

7 Claims, 4 Drawing Sheets

COOLING DEVICE FOR THE PRESSING TOOLS OF AN UPSETTING PRESS AND METHOD FOR OPERATING THE COOLING DEVICE

BACKGROUND OF THE INVENTION

1. Field of the Invention

The present invention relates to a cooling device for the pressing tools of an upsetting press for the width reduction of rolled material, particularly of the width of slabs in hot-rolled wide strip roughing trains. The upsetting press includes two tool carriers which are arranged on both sides of the slab edges. The tool carriers receive the pressing tools and are moved relative to each other. The invention also relates to a method for operating the cooling device.

2. Description of the Related Art

The pressing tools of an upsetting press for reducing the width of slabs in hot-rolled wide strip roughing trains are subjected to extremely high mechanical and thermal loads. Since the temperature of the hot slab entering the upsetting press is approximately 1250° C., and since the pressing tool is subjected during pressing to the direct heat contact with the slab and also to the radiation heat emanating from the hot slab, the pressing tool must be cooled in order to obtain a service life of the tool which is operationally acceptable.

In a known device for changing the cross-section of hot slabs received from a slab casting machine as disclosed in German Offenlegungsschrift 25 31 591, it is proposed to cool the pressing tools by means of an internal circulation of a medium, wherein it is ensured that the working sides of the tools are at or close to the highest permissible temperature in order to remove the smallest amount of heat from the slab and to avoid an excessive wear of the tools.

However, the present invention starts from the finding that the heat flux from the front edge of the pressing tool which comes into contact with the hot slab to the portions of material of the pressing tool which define cooling ducts for reasons of strength, takes place too slowly and, therefore, an internal circulation of a cooling medium is not capable of removing sufficient heat from the pressing tool with the result that the temperature of the tool levels out after a certain period of operation at a temperature which is substantially higher that the highest permissible temperature. Arranging the cooling ducts in the tool at a slight distance away from the pressing surfaces to be cooled has the result that the pressing surfaces of the pressing tool can only be finished to a limited extent and that, therefore, the service life of the pressing tool is reduced to an extent which is economically unacceptable. For reasons of cost, it is also not acceptable to coat the pressing surfaces of the tool with such high-grade materials, for example, by build-up welding, which are capable of withstanding the extremely high operation temperature. In addition, such high-grade metal alloys require technically very difficult finishing of the pressing surfaces.

SUMMARY OF THE INVENTION

Therefore, it is the object of the present invention to provide a cooling device for the pressing tools of an upsetting press which is capable of reliably and continuously cooling each pressing tool to such highest permissible material temperatures at which conventional materials which are resistant to temperature changes can be used and which permit repeated finishing of the highly stressed pressing surfaces of the tool. In addition, it should be possible to use inexpensive materials for the pressing tools. Also, the service life of the pressing tools is to be increased.

In accordance with the present invention, the above object is met in an unexpected simple manner by providing the upsetting press with at least one cooling agent nozzle which is directed toward the regions of the front edge of each pressing tool.

In accordance with a particularly advantageous further development of the invention, this cooling agent nozzle is used for continuously spray-cooling with cooling medium the region of the front edge of each pressing tool.

Contrary to general expectations, an almost stationary temperature pattern is obtained already after a short period of operation which is in the region of the pressing surface substantially below the permissible material temperature and decreases toward the interior of the tool.

A particularly advantageous cooling agent nozzle is a flat jet nozzle with a predetermined spreading angle. This makes it possible to uniformly apply cooling agent to the entire front edge of the pressing tool.

In accordance with another advantageous further development of the invention, a plurality of flat jet nozzles are combined in a nozzle beam. A nozzle beam each is arranged above and below the center of the slab. Advantageously, the nozzle beams are arranged between tyro pressure rolls which hold down the slab. As a result, the supply and distribution of the cooling agent is facilitated while utilizing the narrowest space conditions. If in accordance with another development, the nozzle beam is a structural unit which can be connected by means of a quick-closing connection to at least one cooling agent supply line, the maintenance of the nozzles is substantially simplified. When individual nozzles are damaged, the nozzles can be repaired at a separate maintenance location because the damaged nozzle beam can be exchanged in its entirety against a new or repaired nozzle beam.

Another development of the present invention provides that the axes of the flat jet nozzles are aligned with different angles relative to the front edge of the pressing tool as required by the width of the slab and the distance of the pressing tool from the center of the slab. In addition, each individual nozzle can be switched on and off. The flat jet nozzles can be fixedly adjusted in the nozzle beam, so that individual nozzles relate to certain work positions of the pressing tools in the upsetting press and are switched off when the pressing tool is moved to a new work position, for example, because of a changed width of the slab. Other nozzles corresponding to the new work position of the pressing tools are then switched on. As a result, the adjustment of the nozzles to the various work positions of the pressing tools is significantly simplified. Another advantageous feature provides that the nozzle beam is equipped with sections of several nozzle rows, wherein each nozzle row is connected to a separate cooling agent line and each nozzle row can be switched on and off. By correlating individual nozzle rows to various work positions of the pressing tools, the effect of the spray cooling of the flat jet nozzles is increased and made uniform.

The fact that entire nozzle rows in the nozzle beam can be switched on and off makes it additionally possible that, during the phase of movement in which the pressing tool is raised from the edge of the slab, the region of the front edge of each pressing tool can be supplied from the outside and past the slab with a cooling agent in the form of a spray cooling. In this case, the control of the nozzle valve is advantageously coupled to the control of the pressing tool. The cooling agent is essentially kept away from the slab and particularly from the slab edge, so that the deformation energy introduced by the pressing tools into the slab is sufficient to compensate for the heat loss of the slab due to heat radiation.

Another feature of the present invention provides that, in addition to the spray cooling of the pressing tool applied from the outside, the pressing tool is also internally cooled. In this case, the cooling agent ducts in the pressing tool can be arranged away from the front edge of the tool by such an extent that the pressing surfaces of the pressing tool can be finished several times.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
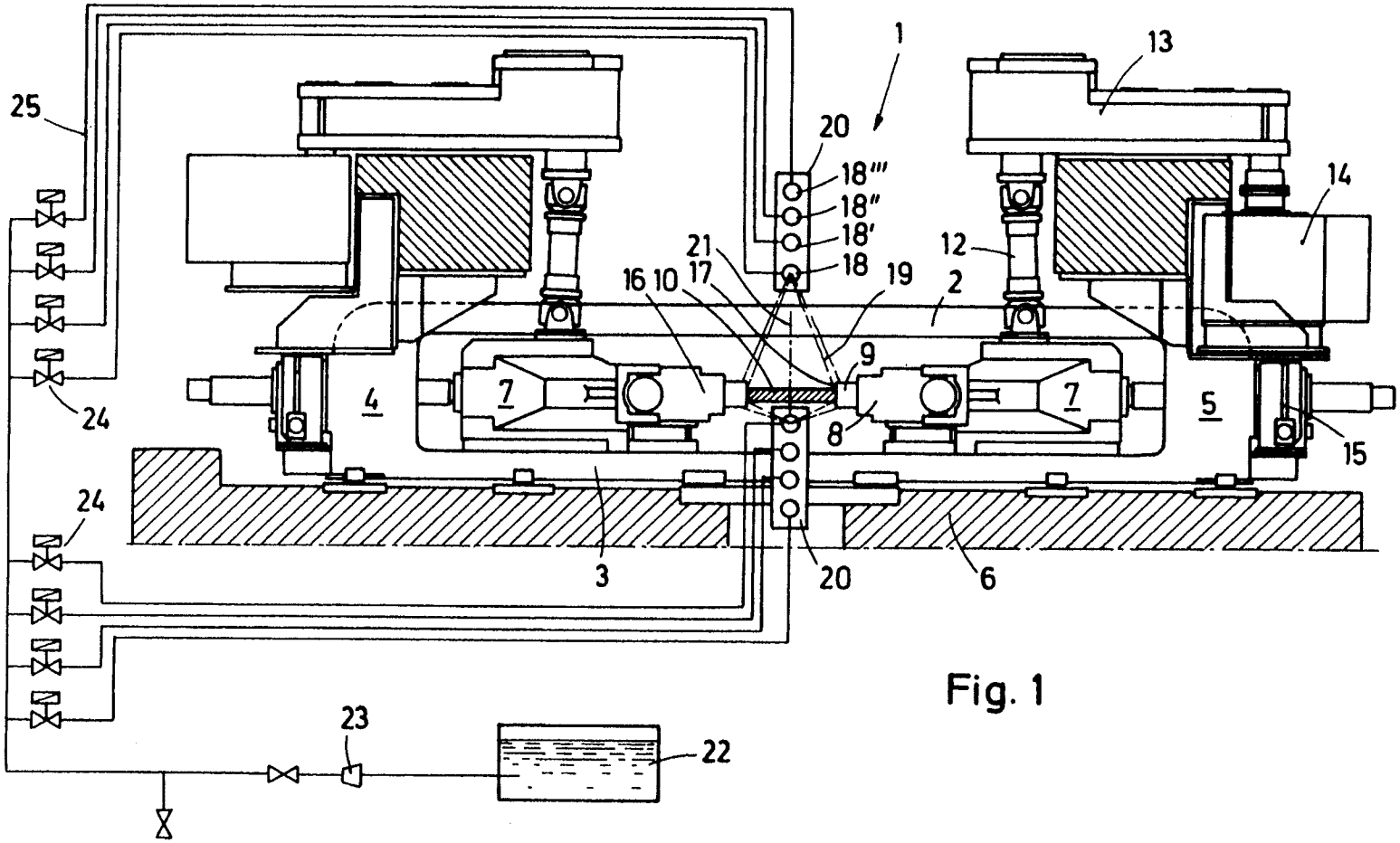
FIG. 1 is schematic view of the cooling device according to the present invention with cooling nozzles being direct against the pressing tools above and below the center of the slab.

FIG. 1 of the drawing shows an upsetting press 1 with a press stand which includes two upper and two lower housing posts 2, 3 and two transverse posts 4, 5, wherein the lower housing posts 3 rest on a foundation 6. The upsetting press 1 additionally includes two crank housings 7 in which is arranged an eccentric driver, not shown, for the translatory movement of the tool carrier 8 and the pressing tool 9. The slab 10 to be upset is located between the pressing tools 9 of the upsetting press 1. The slab 10 is moved through the upsetting press on a roller table, not shown.

Figure 2:
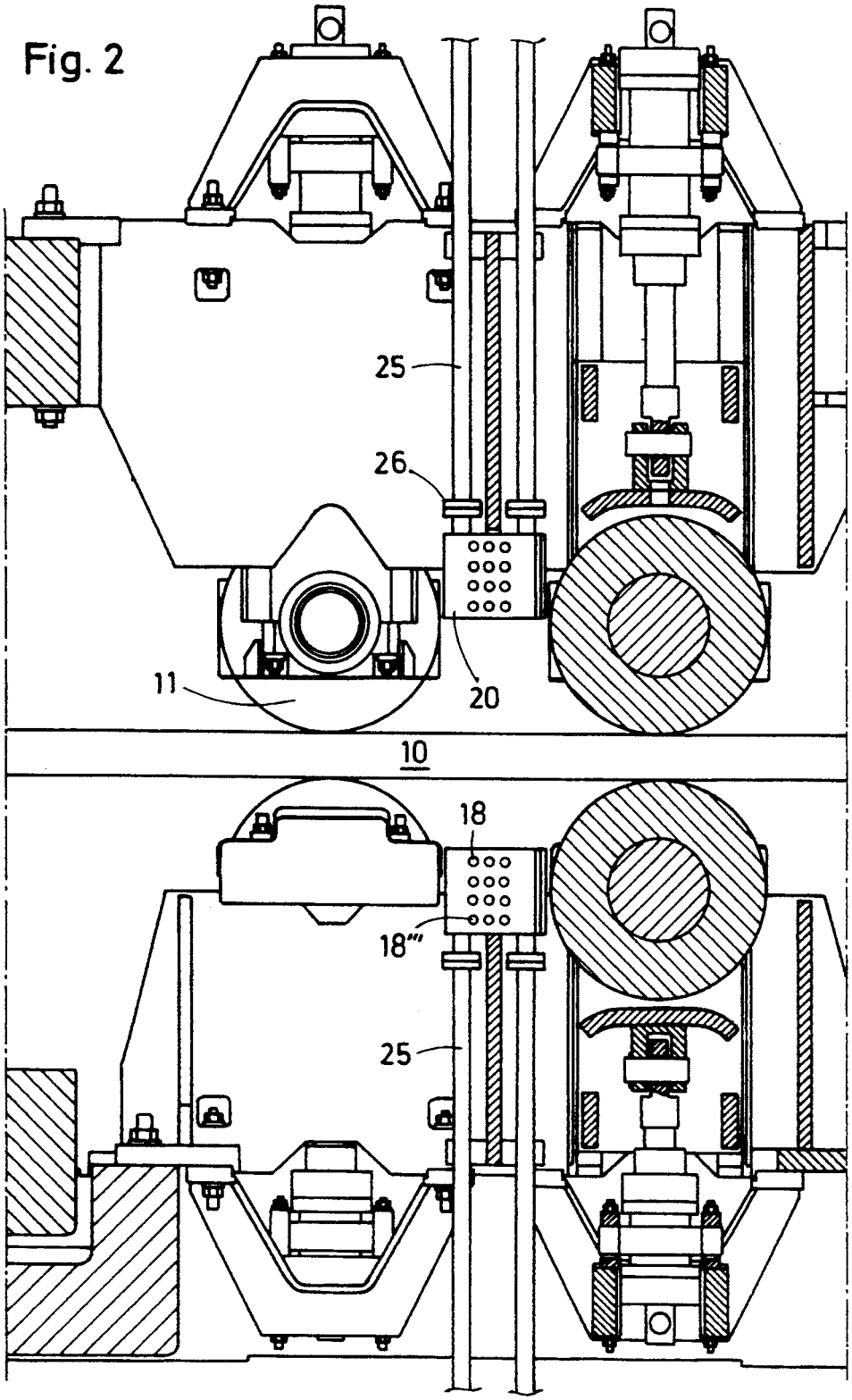
FIG. 2 is a schematic side view showing the arrangement of nozzle beams with several cooling nozzles between holding-down rolls of the upsetting press.

As shown in FIG. 2, a holding-down roll 11 each is arranged above and below the slab in the region of the pressing tools 9. The eccentric drive for tool carrier 8 and pressing tool 9 located in crank housing 7 is driven by a universal joint shaft 12 which is connected through a gear unit 13 to a drive motor 14. The location of the crank housing 7 within the press stand and, thus, the position of the pressing tools relative to the width of the slab is adjusted by means of an adjusting device 15. By means of the drive devices of the upsetting press, i.e., drive motor 14, gear unit 13, universal joint shaft 11 and eccentric drive in crank housing 7, the tool carrier 8 and the pressing tool 9 are moved in direction of the arrow 16 against the edges of the slab in horizontal direction, so that the width of the slab is reduced by a predetermined extent.

The pressing tool is subjected to high mechanical and thermal loads because the slab temperature is approximately 1250° C. and because the pressing tool makes contact with the slab edge during the duration of the pressing procedure. Therefore, the present invention proposes, for cooling the pressing tools, to provide the upsetting press with a plurality of cooling agent nozzles 18 which are directed toward the regions of the front edge 17 of each pressing tool 9.

The cooling agent nozzles 18 are flat jet nozzles with a predetermined spreading angle 19. Several flat jet nozzles 18, 18', 18'', 18''' are combined in a nozzle beam 20, wherein one nozzle beam each is arranged above and below the center 21 of the slab.

FIG. 1 of the drawing illustrates a specific upsetting position for a slab in which the axes of the flat jet nozzles 18 are directed above and below the slab 10 against the front edge 17 of the tool. If wider or narrower slabs are to be pressed to reduce the widths thereof, the flat jet nozzles 18 in the nozzle beam 20 are switched off and, for example, the flat jet nozzles 18' whose axes are now aligned for the new slab widths are switched on.

As illustrated in FIG. 1, the nozzles of the nozzle beam are supplied with cooling agent, preferably water, from a container 22. The cooling agent is supplied to the nozzles by means of a pump 23. Switching the flat jet nozzles in the nozzle beam on and off is carried out by means of switchable valves 24 which are arranged in each individual supply line 25 for the flat jet nozzles.

FIG. 2 shows the arrangement of a nozzle beam 20 each above and below the slab 10 between the holding-down rolls 11. As can be seen in FIG. 2, each nozzle beam 20 is a structural unit with flat jet nozzles being integrated in this structural unit, wherein the nozzle beam is connected by means of quick coupling connections 26 to the water supply line 25.

Figure 3:
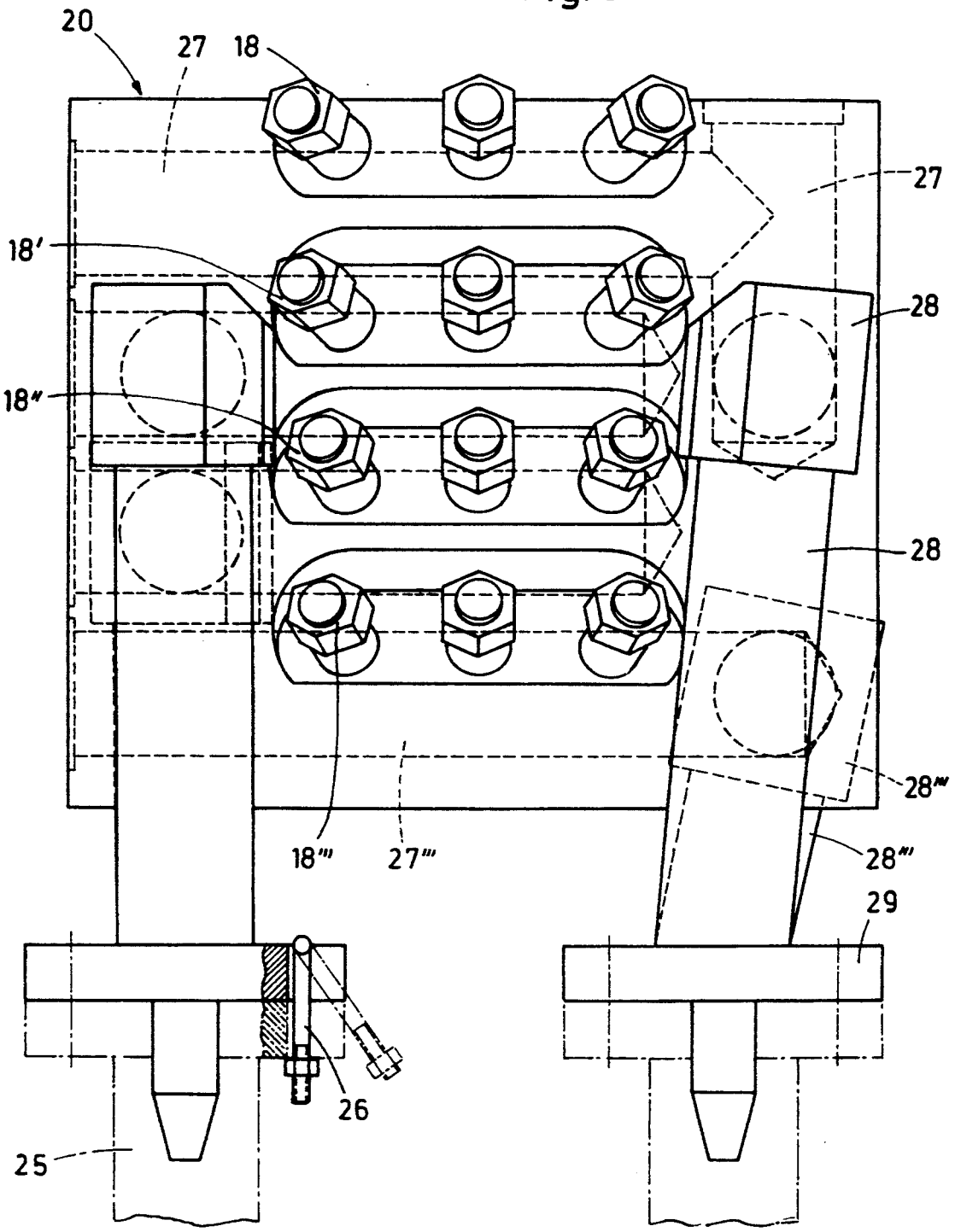
FIG. 3 is an enlarged view of the nozzle beam with flat jet nozzles.
Figure 4:
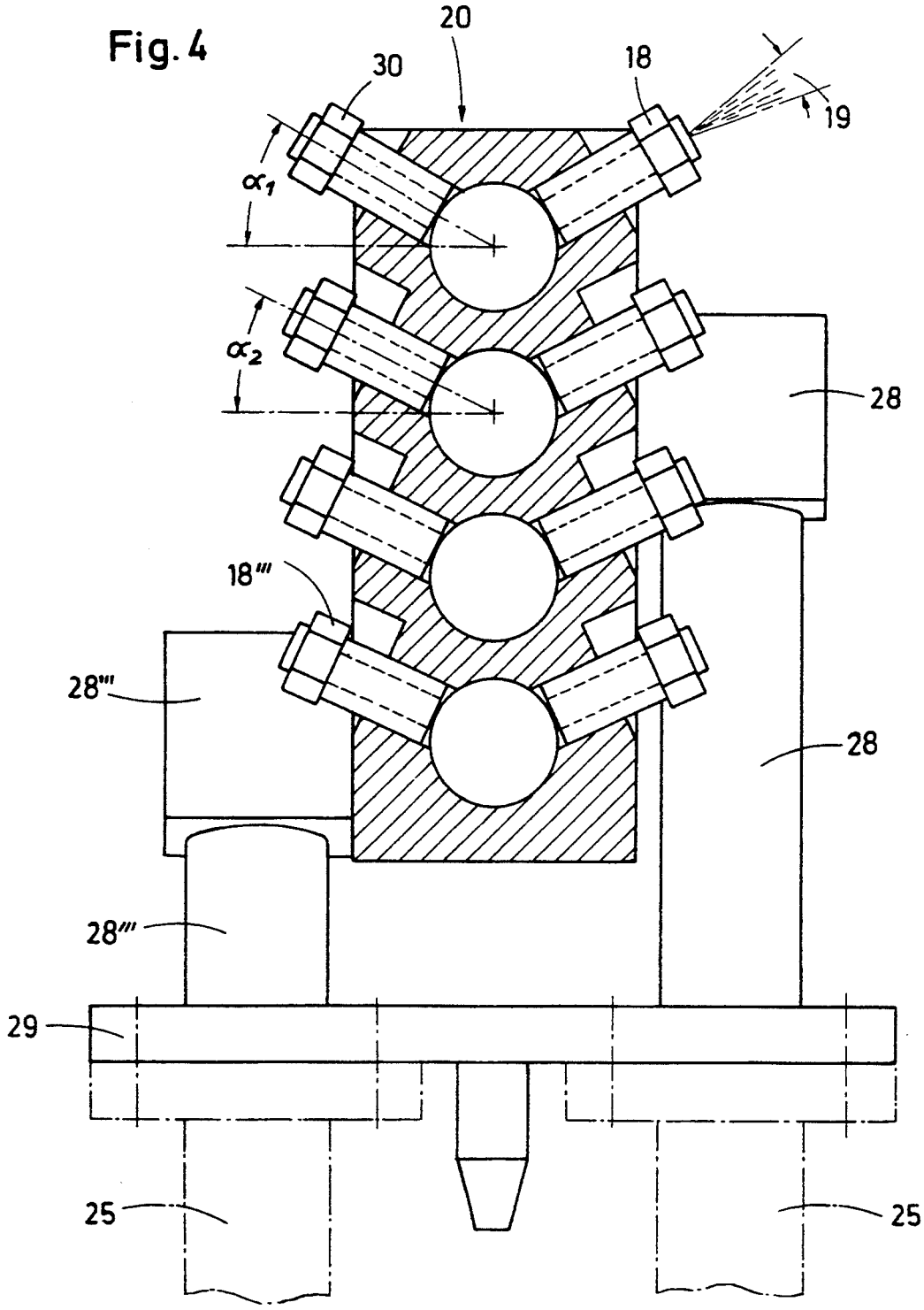
FIG. 4 is a partial sectional view of the nozzle beam of FIG. 3.

FIGS. 3 and 4 show the nozzle beam 20 and the flat jet nozzles 18 arranged in the nozzle beam in more detail. Thus, the nozzle beam is equipped with several nozzle rows 18, 18', 18'', 18''' arranged in sections and each nozzle row is connected with a separate connecting bore 27, 27', 27'', 27'''. As described above, each nozzle row can be switched on and off individually. For example, the nozzle row 18 is in connection with the connecting bores 27 in the nozzle beam and with the connection head 28 and the corresponding supply line shown in FIG. 4. Similarly, the nozzle row 18''' is in connection with the connecting bore 27''' and with the connection head 28''' and the corresponding supply line. The supply lines 28 and 28''' can each be quickly coupled to or uncoupled from the water supply line 25 through a flange 29. Thus, the nozzle beam 20 is replaceable quickly as a structural unit by a new nozzle beam.

The predetermined spreading angle 19 of each flat jet nozzle is schematically indicated in FIG. 4. FIG. 4 also shows the axes 30 of the flat jet nozzles which are oriented at different angles $\alpha_1$ and $\alpha_2$. The angles of the axes are fixedly adjusted as required by the width of the slab and the distance of the pressing tool from the center of the slab.

In operation of the upsetting press, the best cooling effect of the pressing tools can be obtained if the areas of the front edges of the pressing tools are continuously spray-cooled from the outside with the cooling agent, preferably water. After a short period of operation, a thermally stationary state is reached, so that the temperature of the front edge of each pressing tool is below the maximum permissible material temperature. The temperature further decreases toward the interior of the tool. A slightly better cooling effect for the pressing tool can be achieved if, in addition to the spray cooling from the outside as described above, an internal cooling of the pressing tools is carried out, for example, by means of cooling agent ducts, not shown, arranged additionally in the pressing tool at a distance from the front edge 17 thereof. The cooling agent ducts are connected to a cooling agent supply. However, this is technically substantially more complicated. In these cases, the pressing tools can be made of materials which are resistant to temperature changes, whose manufacture is economically advantageous and whose pressing surfaces can be finished several times without unexpected problems.

Satisfactory cooling results of the pressing tools can also be obtained if the pressing tool is spray-cooled only during the upsetting procedure of a slab and not during the periods of intermission between two slabs to be processed or if the region of the front edge of each pressing tool is subjected to a cooling agent in the form of spray-cooling from the outside and past the slab during the phase of movement in which the pressing tool is raised from the slab edge. However, in this case, highly heat-resistant materials must be used, wherein the cooling intensity of the spray cooling is also controlled in accordance with the requirements of the maximum permissible temperatures of the highly heat-resistant material of the pressing tool.

It is within the scope of the invention if at least one cooling agent nozzle is arranged in a guide means which can be swung into the area of the front edge of the pressing tool or if the cooling agent jet is controlled in a different manner so as to follow the movement of the front edge of the pressing tool.

While a specific embodiment of the invention has been shown and described in detail to illustrate the inventive principles, it will be understood that the invention may be embodied otherwise without departing from such principles.

I claim:

1. A cooling device for use in an upsetting press for width reduction of slabs, the upsetting press including two pressing tools having each a front edge, two tool carriers arranged on opposite sides of a slab for receiving the two pressing tools, respectively, and two pairs of spaced pressure rollers arranged above and below the slab in a region of the pressing tools for holding down the slab, said cooling device comprising:

two cooling agent nozzle beams arranged above and below a center of the slab between a respective pair of pressure rollers for directing cooling agent against the front edges of the two pressing tools, wherein each nozzle beam includes a plurality of flat jet nozzles arranged in a plurality of rows, with flat jet nozzles of each row having predetermined spreading angles and having axes thereof directed towards the front edge of the pressing tool at different angles, which depend on a width of the slab and a distance of the pressing tool from the center of the slab;

conduit means for connecting each row of flat jet nozzles of each nozzle beam with a source of a cooling agent; and valve means for each conduit means for switching a respective row on and off.

2. The cooling device according to claim 1, wherein each nozzle beam is connected as a structural unit by means of a connection to at least one cooling agent supply line.

3. The cooling device according to claim 1, wherein each pressing tool comprises additional cooling agent ducts arranged at a distance from the front edge.

4. A method of cooling pressing tools of an upsetting press of width reduction of slabs, the upsetting press including two tool carriers arranged on opposite sides of a slab for receiving the pressing tools and movable relative to each other, said method comprising the steps of:

continuously directing a plurality of separate cooling agent jets having different predetermined spreading angles from outside and past the slab against front edges of the pressing tools for cooling the same during a phase of movement of the pressing tools from edges of the slab during upsetting of the slab;

switching the separate cooling agent jets on and off in accordance with a width of the slab and a position of the pressing tools relative to edges of the slab; and discontinuing cooling of the front edges of the pressing tools during a transition period between an end of an upsetting procedure for one slab and a start of the upsetting procedure for a following slab.

5. The method according to claim 4, comprising the step of controlling a cooling intensity of each cooling agent jet in dependence upon a maximum permissible temperature of a material of each pressing tool.

6. The method according to claim 4, comprising, in addition to the jet cooling of the pressing tool applied from outside, the step of carrying out an internal cooling of the pressing tool.

7. The method according to claim 6, comprising the step of controlling a cooling intensity of the internal cooling of each pressing tool in dependence upon a maximum permissible temperature of a material of each pressing tool.

* * * * *